US007544107B2

(12) United States Patent
Gattuso et al.

(10) Patent No.: US 7,544,107 B2
(45) Date of Patent: Jun. 9, 2009

(54) CONTACT USED IN AN ELECTRICAL CONNECTOR

(75) Inventors: Andrew Gattuso, Chandler, AZ (US); Chi-Nan Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 159 days.

(21) Appl. No.: 11/647,716

(22) Filed: Dec. 28, 2006

(65) Prior Publication Data

US 2008/0160801 A1 Jul. 3, 2008

(51) Int. Cl.
*H01R 4/48* (2006.01)

(52) U.S. Cl. ..... 439/862

(58) Field of Classification Search ..... 439/73, 439/733.1, 66, 515, 862
See application file for complete search history.

(56) References Cited

U.S. PATENT DOCUMENTS 4,354,729 A * 10/1982 Grabbe et al. ..... 439/733.1
5,067,904 A * 11/1991 Takeuchi et al. ..... 439/73
5,437,556 A * 8/1995 Bargain et al. ..... 439/66
5,984,693 A * 11/1999 McHugh et al. ..... 439/66
6,749,440 B1 * 6/2004 Szu et al. ..... 439/66
7,297,010 B2 * 11/2007 Tsai ..... 439/331

* cited by examiner

*Primary Examiner*—Phuong K Dinh
(74) *Attorney, Agent, or Firm*—Wei Te Chung

(57) ABSTRACT

A conductive contact (1) includes a base portion (10) extending along a upright direction, an extending portion (13) extending from the base portion (10), a spring portion (14) extending upwardly from the extending portion (13) with a contacting portion extending portion (13) on a top end thereof, a tail (11) formed on a distal end thereof. Wherein the contact (1) further defines a head portion (12) extending upwardly from the base portion (1) for abutting against the extending portion (13) during the contact (1) sliding at a predetermined trace.

1 Claim, 7 Drawing Sheets

PROIR ART

CONTACT USED IN AN ELECTRICAL CONNECTOR

BACKGROUND OF THE INVENTION

1. Field of the Invention

The present invention generally relates to the field of electrical connectors. And more particularly, one embodiment of the present invention relates to an electrical connector embedded with conductive terminals for connecting a chip module to a printed circuit board.

2. General Background

Electrical connectors are widely used in various computer systems for forming electrical connection between two separate electrical interfaces, such as an electronic component and a printed circuit board. Referring to FIGS. 1-2, an electrical connector 100 basically includes an insulative housing 20 defining a number of passageways 22 and a number of conductive terminals 30 residing in corresponding passageways 22, respectively. The conductive terminal 30 includes a vertical securing section 32 received in the passageway 22 of the housing 20, a connecting portion 36 extending from the securing portion 32, a contacting portion being provided at a top end of the connecting portion, a tail portion 34 extending from a lower end of the securing portion 32, and a transitional portion 35 formed between the tail portion 34 and the securing portion 32. The securing portion 32 defines a securing surface 322 and the transitional portion 35 is bent in a direction vertical to the securing surface 322. The transitional portion 35 can provide the terminal 30 with an elastic flexibility in a direction vertical to the printed circuit board, thereby preventing the terminal 30 from breaking due to lack of the elastic flexibility required in the vertical direction to the printed circuit board.

However, with the development of the chip module 40 forward high density and minimized size and solder pads of the chip module are arranged more smaller and density than ever, the arrangement of terminals 30 received in the electrical connector is more and more compact. While the terminals bear greater and more complicate force, terminals with minimized size and greater flexibility are more and more needed. However in the contact abovementioned, the contacting portion of the contact is sliding in a single direction, which do not provide a to-and-fro sliding trace that could decrease the contacting area needed and ensure a reliable connection between the contact and the conductive pad of the chip module. That is to say, the terminal provides a single directional movement to the printed circuit board, which can not meet the need of multi-directional flexibility of the terminals.

Therefore, there is a heretofore unaddressed need in the industry to address the aforementioned deficiencies and inadequacies.

SUMMARY

According to an embodiment of the present invention, a conductive contact includes a base portion extending along a upright direction, an extending portion extending from the base portion, a spring portion extending upwardly from the extending portion with a contacting portion on a top end thereof, a tail formed on a distal end thereof. Wherein the base portion further defines a reinforcing portion extending upwardly from the base portion for abutting against the extending portion during the contact sliding at a predetermined trace.

In relative to the conventional technology, the contact provides a engagement between the ached portion and the reinforcing portion during the contact is pressed down, which entails a contact wiping movement in two directions, hence decreasing the contacting surface against which the contacting portion abuts.

The present invention is illustrated by way of example and not limitation in the figures of the appended drawings, in which like references indicate identical elements, and in which:

DETAILED DESCRIPTION OF THE EMBODIMENTS

In the following description, for purpose of explanation, numerous details are set forth in order to provide a thorough understanding of the embodiments of the present invention. However, it will be apparent to one skilled in the art that these specific details are not required in order to practice the embodiments of the present invention.

The following description includes terms such as upper, lower, upwardly and the like, that are used for descriptive purpose only and are not to be construed as limiting. That is, these terms are terms that are relative only to a point of reference and are not meant to be interpreted as limitation but are instead, included in the following description to facilitate understanding of the various aspects of the present invention.

Figure 1:
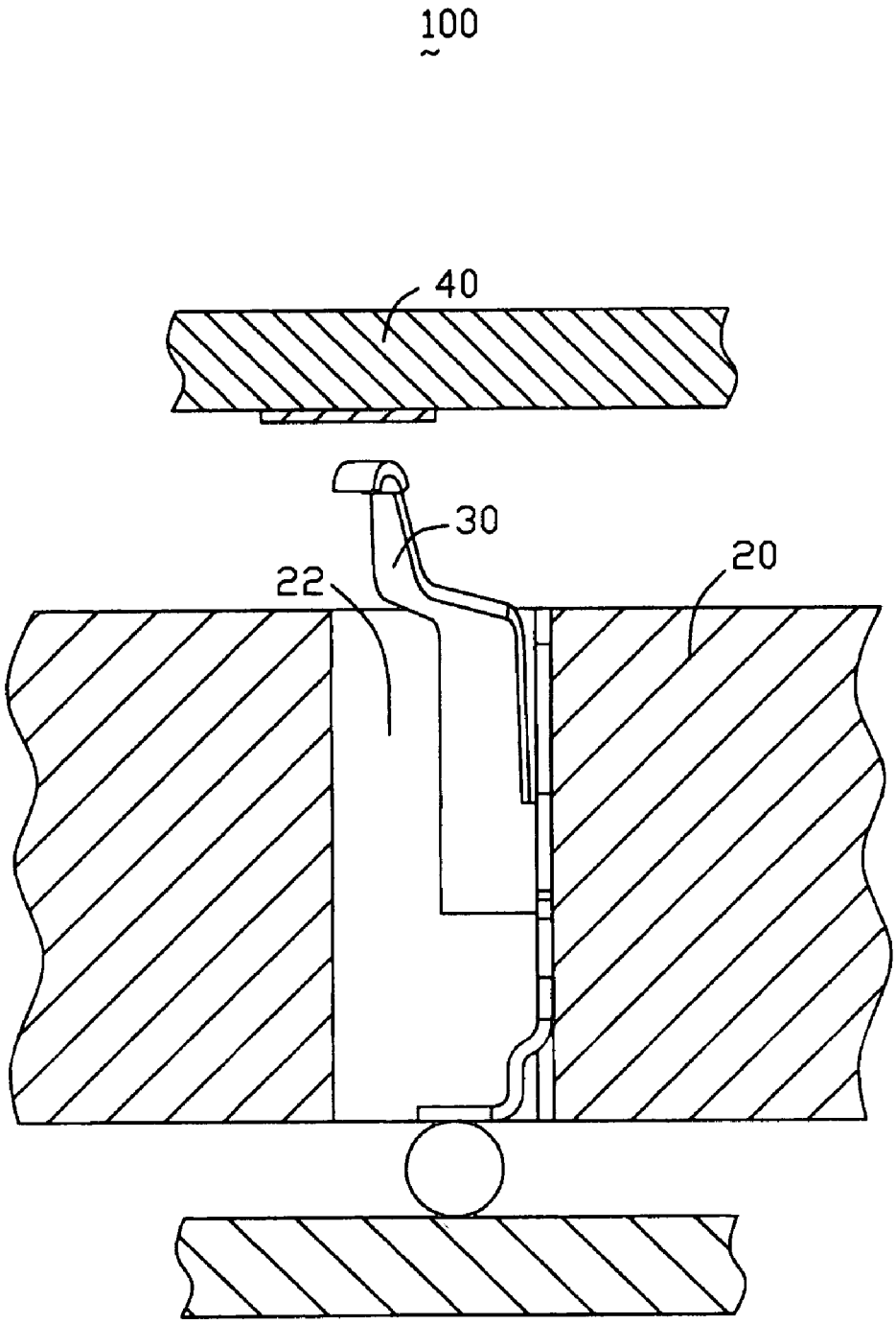
FIG.1 PRIOR ART
FIG. 1 depicts an exemplary cross-sectional view of a conventional electrical connector, wherein the contact has been inserted into the housing.
Figure 2:
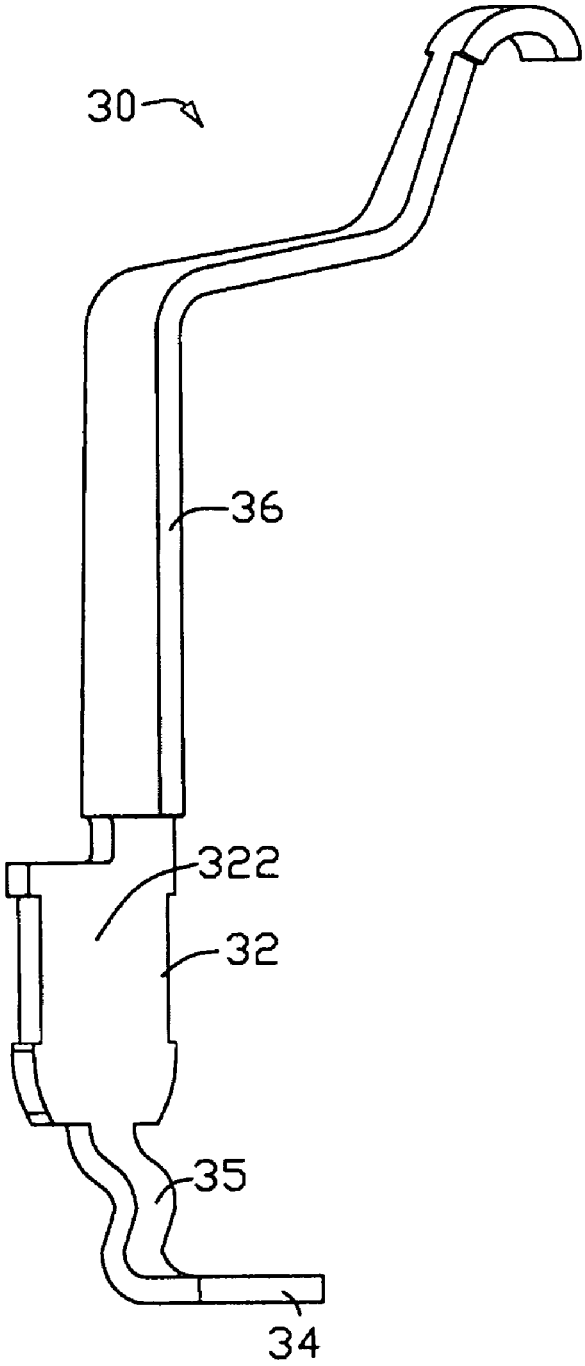
FIG. 2 depicts an exemplary isometric view of a conductive contact shown in FIG. 1.
Figure 3:
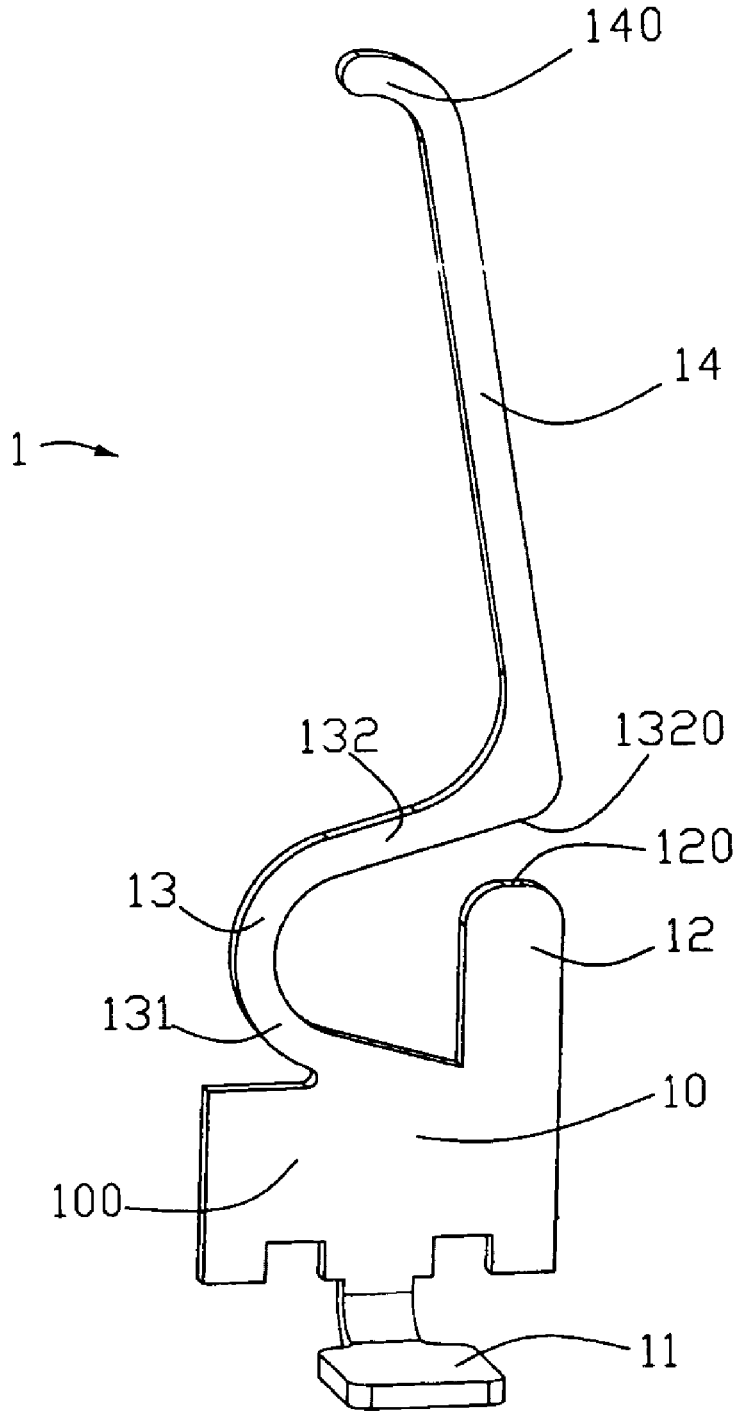
FIG. 3 depicts an exemplary isometric view of a contact in accordance with the embodiment of the invention.
Figure 4:
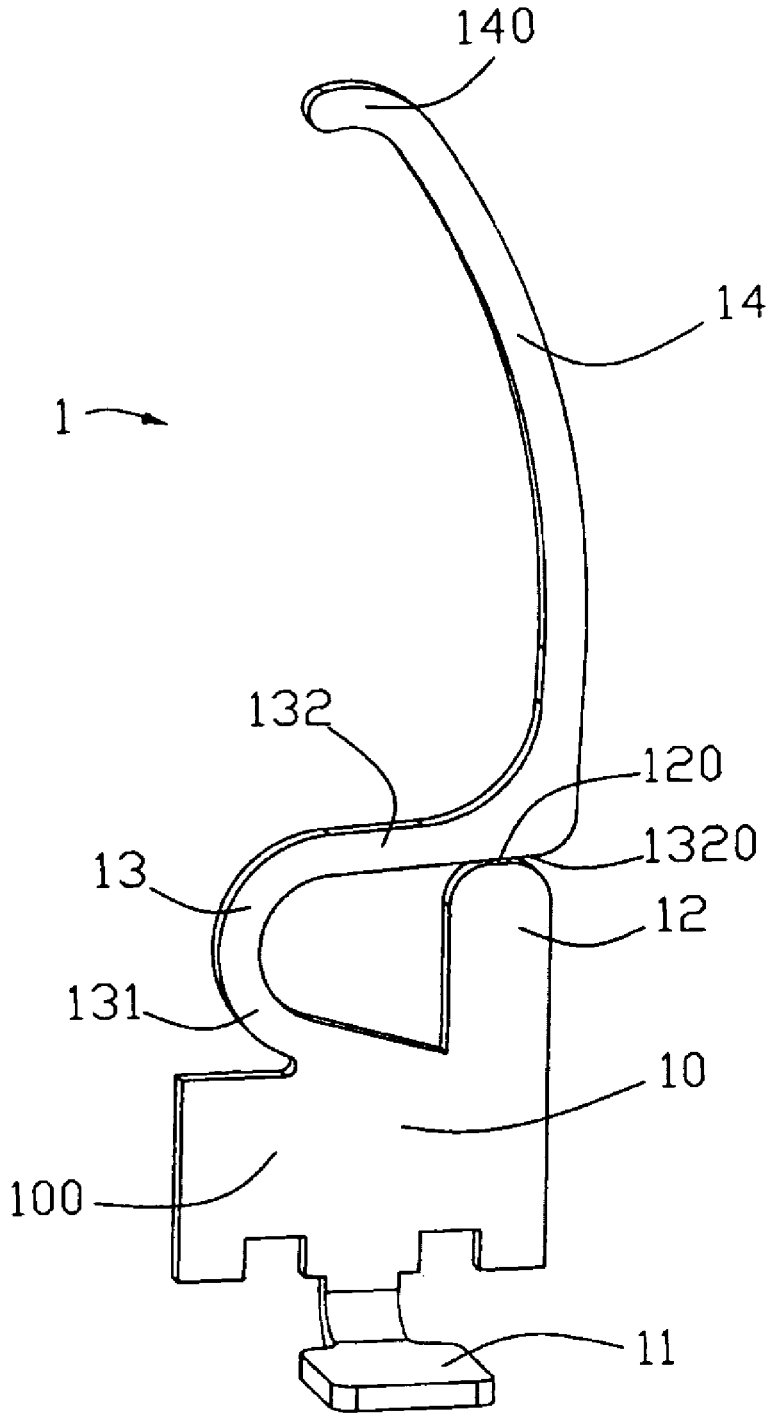
FIG. 4 depicts a perspective view of the contact shown in FIG. 3, when the contact is pressed downwardly and slides in a first direction.
Figure 5:
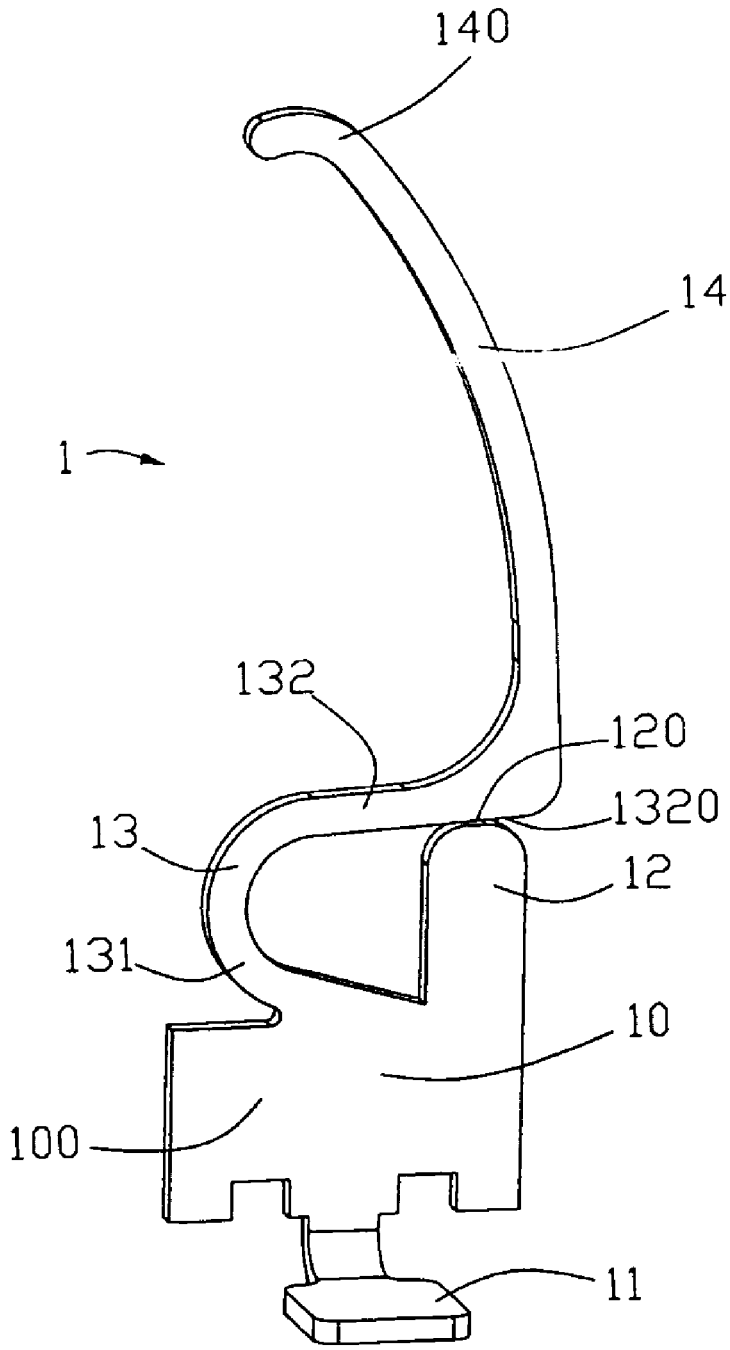
FIG. 5 depicts a perspective view of the contact shown in FIG. 3, when the contact is pressed downwardly and slides in a second direction opposite to the first direction.
Figure 6:
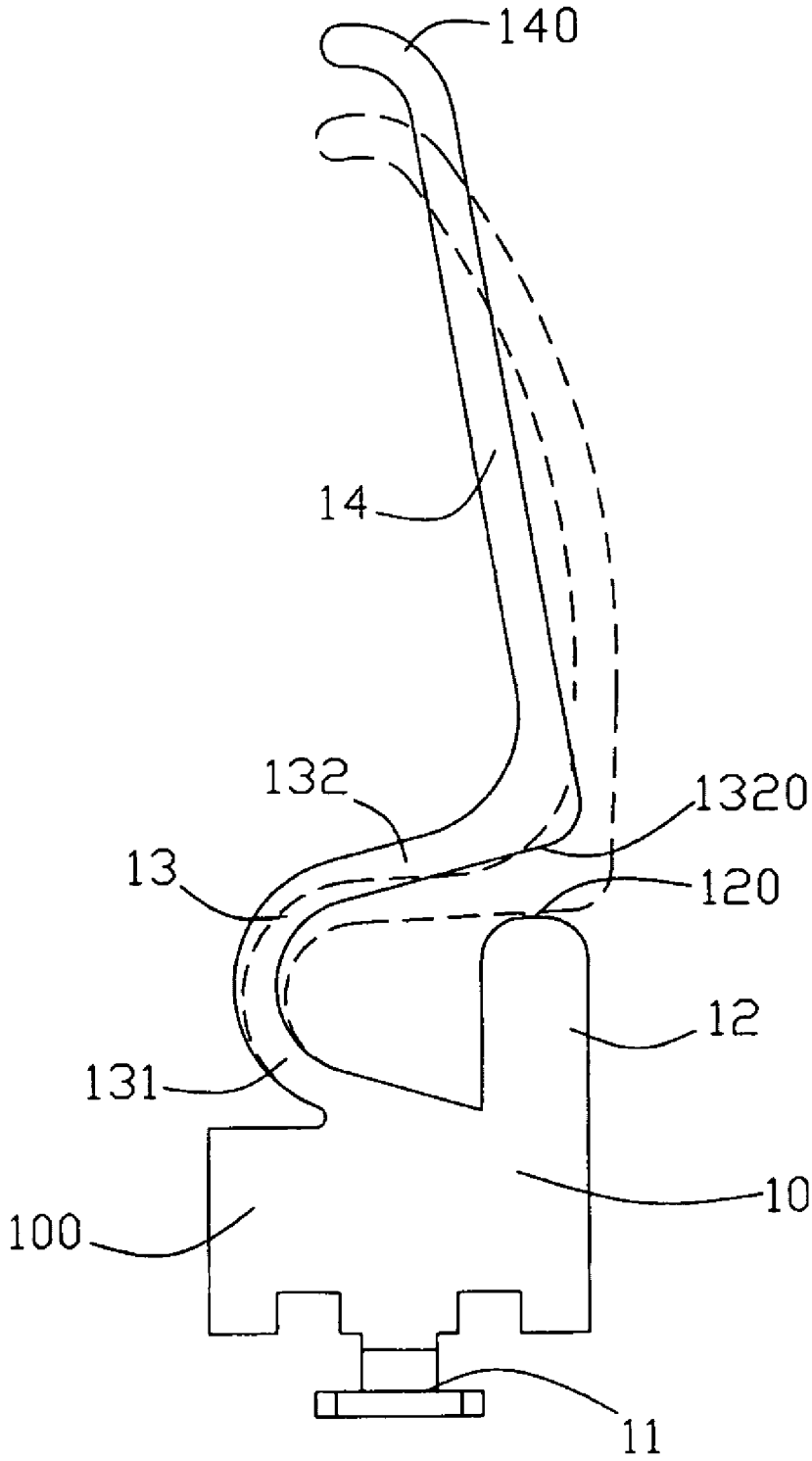
FIG. 6 depicts an assembled perspective view of the contact shown in FIG. 3, when the contact is pressed downwardly and slides from the position shown in FIG. 1 to the position FIG. 2 in a first direction, wherein the broken line discloses the first position of the contact sliding shown in FIG. 2.
Figure 7:
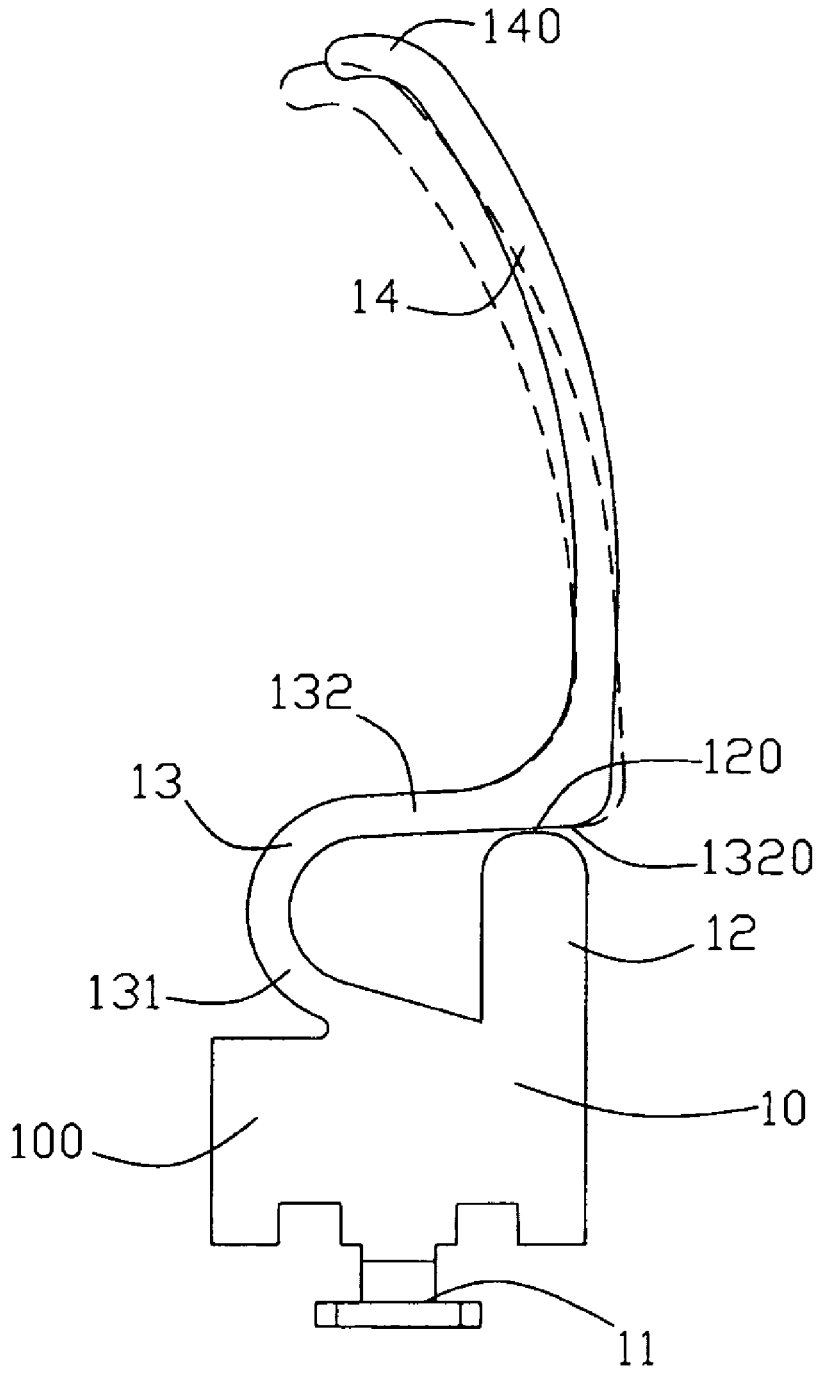
FIG. 7 depicts an assembled perspective view of the contact shown in FIG. 3, when the contact is pressed downwardly and slides from the position shown in FIG. 2 to the position FIG. 3 in a second direction opposite to the first direction, wherein the broken line discloses the second position of the contact sliding shown in FIG. 3.

Referring to FIG. 3, a conductive contact 1 according to a preferred embodiment of the present invention, is mainly used to electrically connect two electrical components, e.g. an IC package and a PCB, but not limited thereto comprises.

Referring also to FIG. 3, each contact 1 in light of the embodiment of the present invention is formed from conductive material and has a vertical plate-like base 10 with a major vertical surface 100.

For providing a two direction's wiping of the contact 1 during the contact 1 received in the housing is pressed, an upright rectangular plate-like head portion 12 coplanarly projecting from a top end of the base 10, for supporting a distal end of the second directional extending portion. It should be understood that the head portion 12 can be configured to have other configurations for fitting the others configurations of the housing.

A tail 11 is connected to a bottom end of the base 10, having a vertical position with respect to the base 10. The tail 11 has a relatively larger bottom surface vertical to the major surface 100 of the base 10 and adapted to engage a solder member, e.g. solder ball, thereby establishing electrical engagement between the contact 1 and the PCB.

An extending portion 13 with an elongated arch-shaped configuration extends from the base portion 10 and comprises a first directional extending portion 131 and a second directional extending portion 132 opposite to the first extending portion' extending direction for providing a spring force, which makes the contact 1 slide in a direction opposite to the initial sliding direction, Wherein the initial direction is a sliding direction the contact is pressed from an original position. The extending portion 13 arcurately extends towards the head portion 12 and defines a joint portion 1320 connecting the second directional extending portion 132 with the first directional extending portion 132, which is defined higher than a top end of the head portion 12 for elastic contacting with the head portion 12.

A spring portion 14 extending from the free end of the extending portion 13 with an elongated body with a contacting portion 140 being disposed at a distal end thereof for contacting with contacting pads of the chip module.

When the contact 1 is assembled into the passageways of the housing, the contact 1 stands in an original state with the contacting portion located in a higher position. Then the chip module is mounted on the housing with the contacting pads contacting with the contacting portion of the contact 1, at the moment, the contacting portion 140 is pressed downwardly and bent to a first position where the joint portion 1320 of the extending portion 13 elastic abuts against the top end 120 the header portion 12. Successively, the spring portion 14 restores in an opposite direction to the first position by a force applied by the header portion 12 and the contact 1 companied with the spring portion slides to in the same direction. So the contact's design provides a to-and-fro movement, which decreases the contacting surface, needed by the contacting portion, hence providing a reliable and stable connection between the contact 1 and the chip module.

With this arrangement design of the contact 1, when the IC package is pressed down, the conductive pad has a bottom surface pressed the contacting portion 140 of the contact 1 to urge the spring portion 14 of the contact 1 to resiliently deform down. Because the contact 1 has the above-described extending portion 13 with good resilient characteristics, and an effective supporting of the reinforcing portion 12 during the contact 1 being pressed, a to-and-fro wiping movement can be gained to assure good engagement between the chip module and the contact 1.

In connection with the preceding description, the electrical contacts 1 in accordance with embodiments of the present invention can create multi-directional wiping effect, which possibly optimize electrical and mechanical connection between contacts and the printed circuit board.

While the present invention has been illustrated by description of embodiments thereof, and while the embodiments have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

The invention claimed is:

1. A conductive contact assembled in a connector socket for establishing electrical connection between a chip module and a printed circuit board, the conductive contact comprising:

a base portion;

a head portion extending from an upper side of the base portion;

an extending portion extending from the base portion from a position adjacent to the head portion, the extending portion having a first extending portion extending toward the head portion, a second extending portion extending away from the head portion and a joint portion connecting the first and the second extending portions and disposed adjacent the head portion to abut against the head portion when the extending portion is pressed;

a tail extending from a distal end of the base portion for connecting with the printed circuit board, wherein the extending portion and the head portion extend from a same side of the base portion, wherein the second extending portion has a contacting portion on a free end thereof for contacting with the chip module, wherein the contacting portion defines a first position where the joint portion abutting against the head portion and a final position where the contacting portion is lower than the first position, wherein the second extending portion is pressed to deform after the joint portion abuts against the head portion.

* * * * *